US005095562A

United States Patent [19]

Alexander

[11] Patent Number: 5,095,562

[45] Date of Patent: Mar. 17, 1992

[54] ADJUSTABLE BED AND INTERCHANGEABLE DRIVE UNIT THEREFOR

[75] Inventor: James H. Alexander, Acton, Canada

[73] Assignee: Equi-Tron, Inc., Niagara Falls, N.Y.

[21] Appl. No.: 612,416

[22] Filed: Nov. 13, 1990

[51] Int. Cl.[5] ..... A61G 7/00

[52] U.S. Cl. ..... 5/616; 5/611; 5/619

[58] Field of Search ..... 5/66–69, 5/63

[56] References Cited

U.S. PATENT DOCUMENTS

| | | | |
|---|---|---|---|
| 2,699,688 | 1/1955 | Sutton | 5/69 X |
| 3,216,026 | 11/1965 | Mann | 5/66 |
| 3,797,273 | 3/1974 | Benoit et al. | 5/66 X |
| 3,965,500 | 6/1976 | Stein, Jr. | 5/68 |
| 4,202,062 | 5/1980 | Marcyan | 5/66 |
| 4,545,084 | 10/1985 | Peterson | 5/69 |
| 4,592,104 | 6/1986 | Foster et al. | 5/63 X |
| 4,660,236 | 4/1987 | Peterson | 5/69 |
| 4,685,160 | 8/1987 | Rizzardo | 5/66 X |

*Primary Examiner*—Michael F. Trettel

*Attorney, Agent, or Firm*—Robert P. Simpson; Michael L. Dunn

[57] ABSTRACT

An adjustable bed and interchangeable drive unit therefor, which includes a bed frame, a plurality of separately adjustable bed sections pivotally secured to the frame, a corresponding plurality of controller shafts wherein each shaft controls one of the adjustable bed sections, a manual drive unit comprising a plurality of handcranks for individually driving each of the plurality of controller shafts, a powered drive unit comprising at least one electric motor operatively arranged for individually driving each of the controller shafts, and quick disconnect/connect means for interchanging the manual drive unit and the powered drive unit, wherein only one of the drive units is secured to the bed at any one time.

8 Claims, 6 Drawing Sheets

ADJUSTABLE BED AND INTERCHANGEABLE DRIVE UNIT THEREFOR

BACKGROUND OF THE INVENTION

The present invention relates generally to adjustable beds, and more particularly to an interchangeable drive unit for adjustable beds.

Adjustable beds are well known in the art and are used extensively in hospitals, nursing homes, and private homes by people who must spend extensive periods of time in bed for reasons of health, injury, or physical handicap. More recently, adjustable beds have gained in popularity for general home use by people who simply want to be more comfortable when sleeping, reading, watching television, etc.

In general, adjustable beds are categorized as either manual or powered. Manual beds utilize hand cranks to move the adjustable sections of the bed to the desired attitude and height, whereas powered beds use electric motors or hydraulic actuators to perform the same result.

Typically, both manual and powered beds have three, four, or even five articulated sections which may be separately adjusted. A common arrangement, for example, includes a head adjustment, a leg adjustment, and a bed height adjustment (which raises or lowers the entire bed). Usually, each adjustable section of the bed has a separate actuator, including a rotatable shaft, which turns in one direction to raise the section and in the opposite direction to lower the section.

There are advantages and disadvantages associated with both manual beds and powered beds. Manual beds are less expensive than powered beds and are usually simpler in construction, which makes them easier to repair. The disadvantages of a manual bed are the requirement that another person must be available to operate the bed (assuming the person in bed is bedridden), as well as the extra effort and awkwardness of turning the handcranks, etc. Powered beds are, of course, much easier to use and may even be controlled by the bedridden person himself. Motor-powered beds are substantially more expensive than manual beds, however, and are generally more difficult to repair as well.

Due to the high cost of powered beds, many people who require an adjustable bed in their home purchase or rent a manual bed. If, at a later time, the user wishes to upgrade to a powered bed, the general trend has been for the user to sell the manual bed and purchase a powered bed, or to trade in the manual bed and pay extra for the powered bed. This has generally necessitated that adjustable bed dealers carry inventories of both manual and powered beds.

Another problem typically encountered with powered beds is that of repair. In very early models, a motor failure required a service call by a repairman and sometimes resulted in temporary loss of bed function until the motor problem was resolved. Improved beds provided an emergency handcrank which could be used to power the bed manually until the motor was repaired. A further improvement is disclosed in U.S. Pat. No. 4,545,084 (Peterson) which describes a modular drive arrangement for adjustable beds. The Peterson invention provides individually interchangeable motor and manual drive units which allegedly may be interchanged without disturbing the patient. Unfortunately, assuming a person is in the bed, it is necessary to crawl under the bed to interchange one of the Peterson drive units. To ensure sufficient clearance for the serviceman to be able to crawl under the bed, it is necessary that the bed have adjustable legs so that the entire bed can be raised off the floor (presumably the patient must be removed from the bed before this can be accomplished). Another problem with the Peterson bed is that the service person must troubleshoot a defective bed to determine which drive unit is in need of repair. To diagnose a defective bed, it is again necessary to crawl under the Peterson bed to determine which drive unit is defective, or else remove the mattress and bedding (and the patient) to enable a visual inspection of the moving parts.

Adjustable beds are, of course, usually more complicated in construction than conventional beds. Due to this more complex construction, it is generally more difficult to disassemble, transport and reassemble adjustable beds. This is especially troublesome in that there is usually a much greater need to transport adjustable beds than conventional beds.

SUMMARY OF THE INVENTION

The present invention is an adjustable bed and interchangeable drive unit therefor, which includes a bed frame, a plurality of separately adjustable bed sections pivotally secured to the frame, a corresponding plurality of controller shafts wherein each shaft controls one of the adjustable bed sections, a manual drive unit comprising a plurality of handcranks for individually driving each of the plurality of controller shafts, a powered drive unit comprising at least one electric motor operatively arranged for individually driving each of the controller shafts, and quick disconnect/connect means for interchanging the manual drive unit and the powered drive unit, wherein only one of the drive units is secured to the bed at any one time.

A primary object of the invention is to provide an adjustable bed and interchangeable drive unit therefor, which permits an easy conversion from manual drive to power drive and vice versa without disturbing the person in the bed, and without the need for the repairperson to crawl under the bed.

A further object is to provide an interchangeable drive unit for an adjustable bed which may be easily replaced in the event of failure, obviating the need for on-site troubleshooting and diagnosis by the service technician.

Another object is to provide a drive unit which controls all bed functions and yet may be easily interchanged.

Still another object is to provide an adjustable bed which may be disassembled easily and quickly, and whose individual components may be conveniently nestled together for compact storage and/or transport.

These and other features, advantages and objects of the present invention will be appreciated by those having ordinary skill in the art in view of the following specification, claims and appended drawings.

1, with the adjustable foot section in an elevated position.

Figures 1, 2:
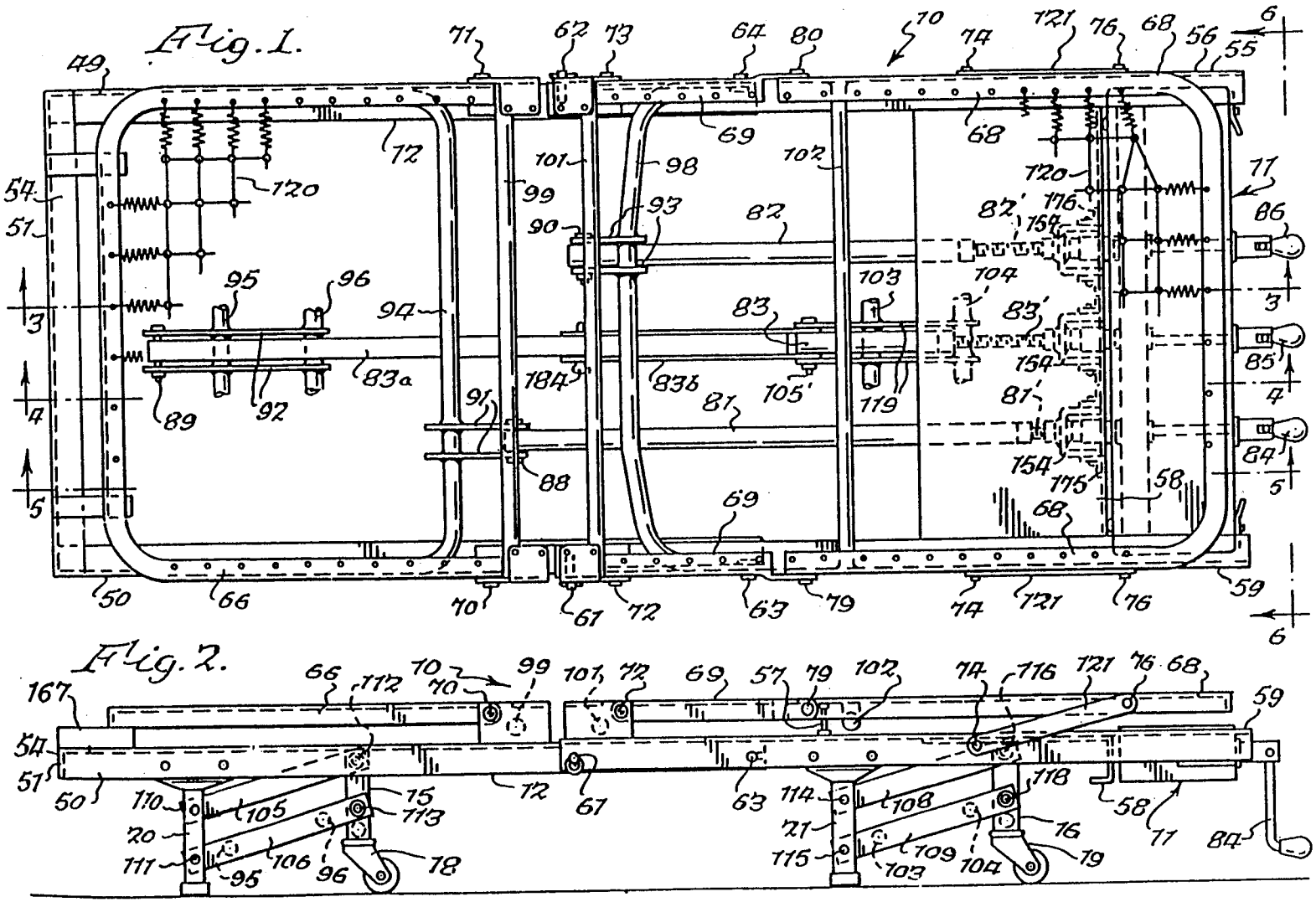
FIG. 1 is a top plan elevation of the adjustable bed of the invention with the manual drive unit installed.
FIG. 2 is a side elevation of the adjustable bed shown in FIG. 1.
Figures 3, 4, 5:
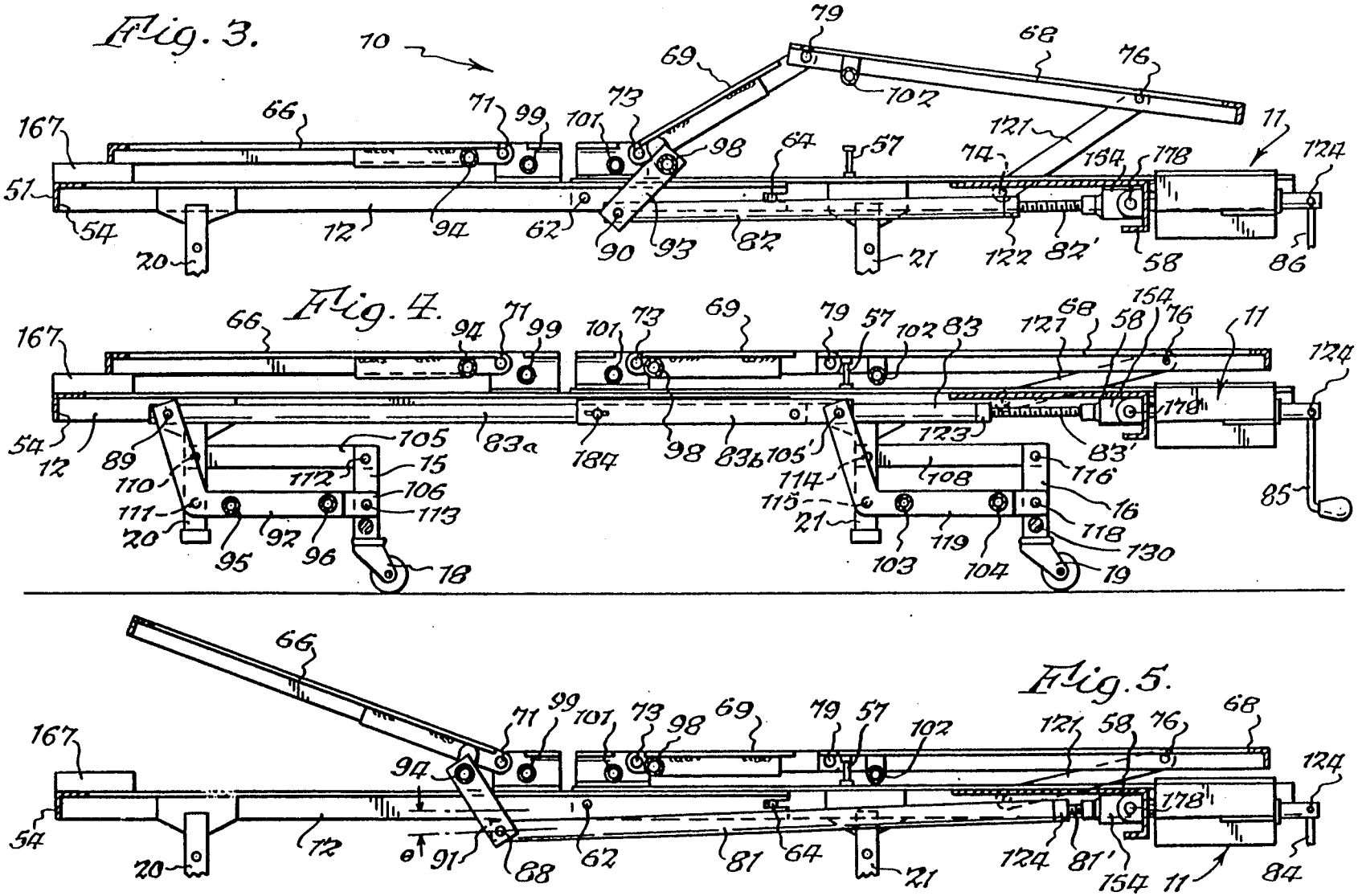
FIG. 3 is a vertical cross-section of the bed with sections cut away, taken generally at line 3—3 of FIG.

FIG. 4 is a view similar to FIG. 3, except taken generally at line 4—4 of FIG. 1.

FIG. 5 is a view similar to FIGS. 3 and 4, except taken generally at line 5—5 of FIG. 1.

Figures 6, 7, 8, 9:
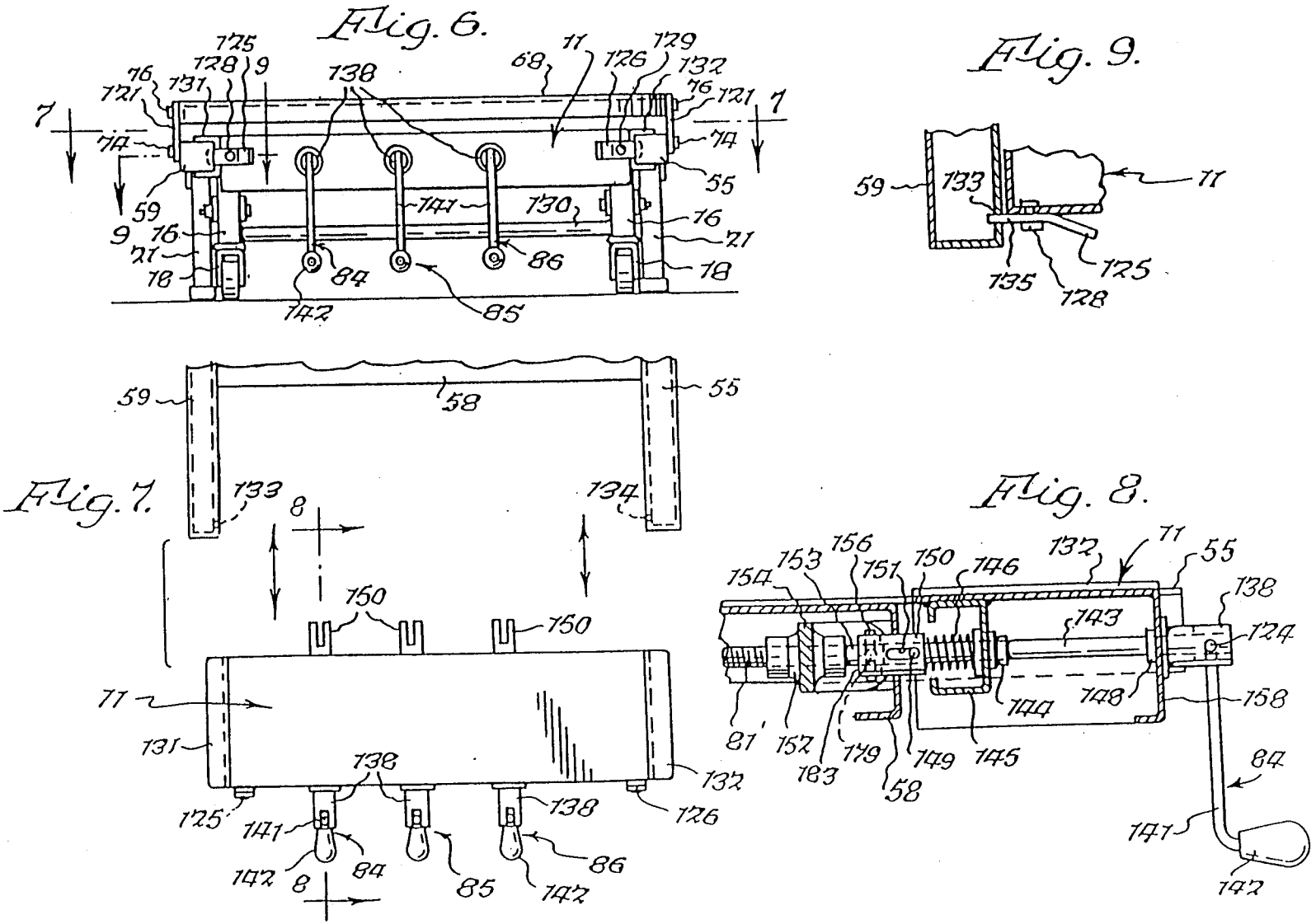

FIG. 6 is a foot-end elevation of the bed of FIG. 1.

FIG. 7 is a fragmentary horizontal cross-section of the bed taken generally at line 7—7 of FIG. 6, which illustrates how the manual drive unit slidingly engages the foot-end of the bed frame.

FIG. 8 is a vertical cross-section of the manual drive unit and coupling taken generally at line 8—8 of FIG. 7, showing the unit in engagement with the bed parts.

FIG. 9 is a fragmentary section taken generally at line 9—9 of FIG. 6 which illustrates how the drive unit latches onto the bed frame.

Figures 10, 11, 12, 12A:
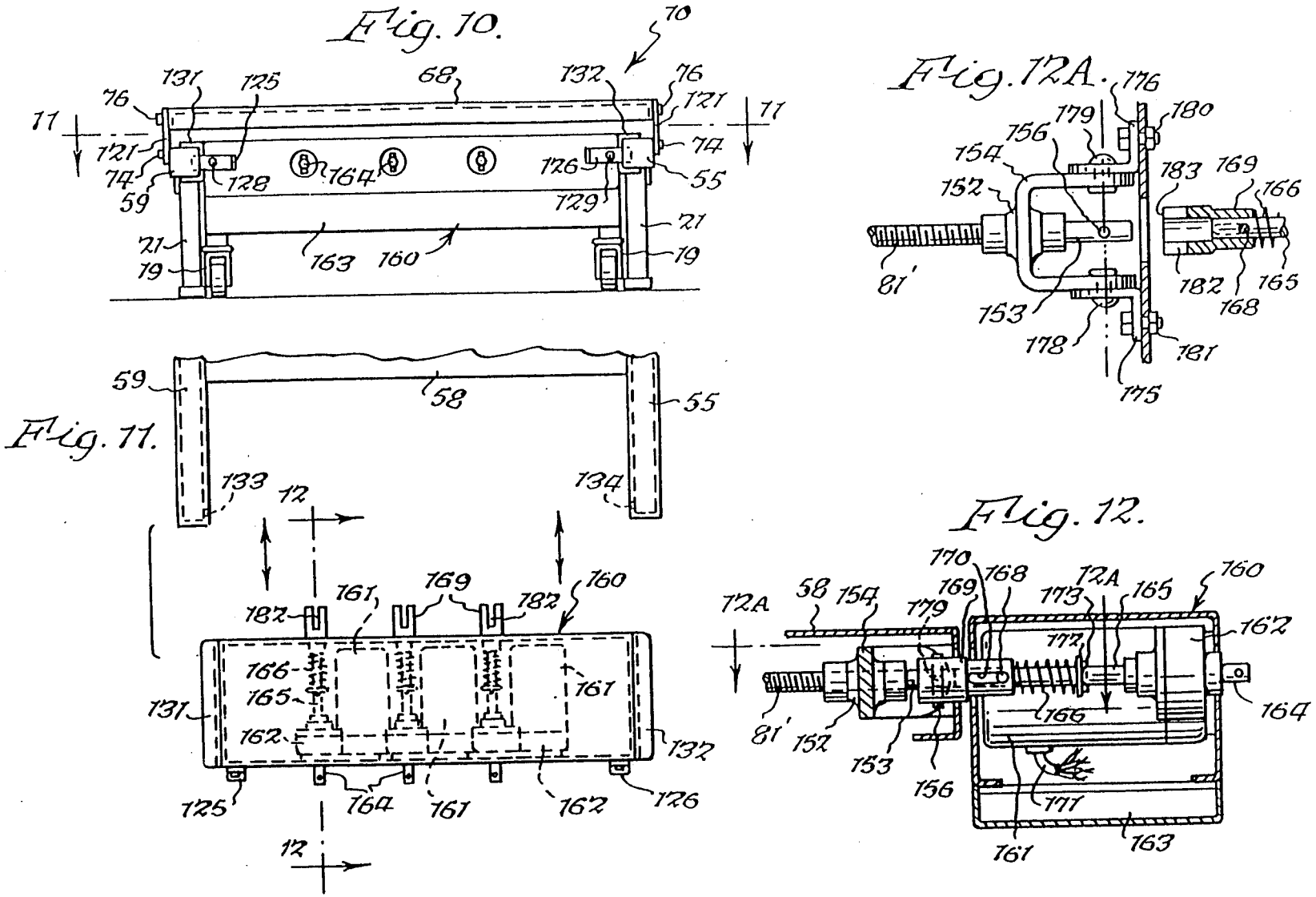

FIG. 10 is a view similar to FIG. 6, except illustrating the motor drive unit installed in the bed.

FIG. 11 is a view similar to FIG. 7, except illustrating the motor drive unit installed in the bed.

FIG. 12 is a view similar to FIG. 8, except illustrating the motor drive unit installed in the bed, and taken generally on line 12—12 in FIG. 11.

FIG. 12A is a partially exploded horizontal cross-section taken along line 12A—12A of FIG. 12, illustrating the coupling of the drive unit to the drive jack.

Figure 13:
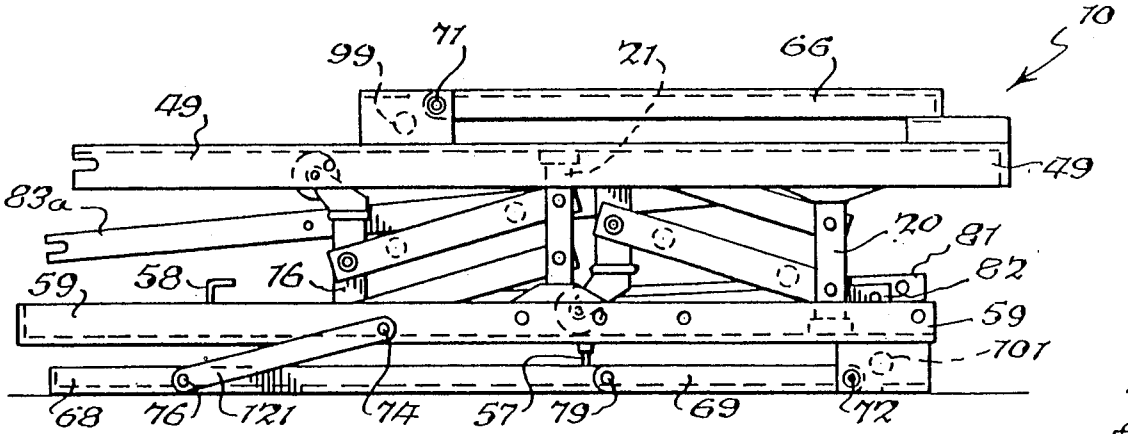

FIG. 13 is a side elevation of the adjustable bed of the invention, illustrating how the bed may be separated into two pieces which nest together which makes the bed easier to transport or store.

Figure 14:
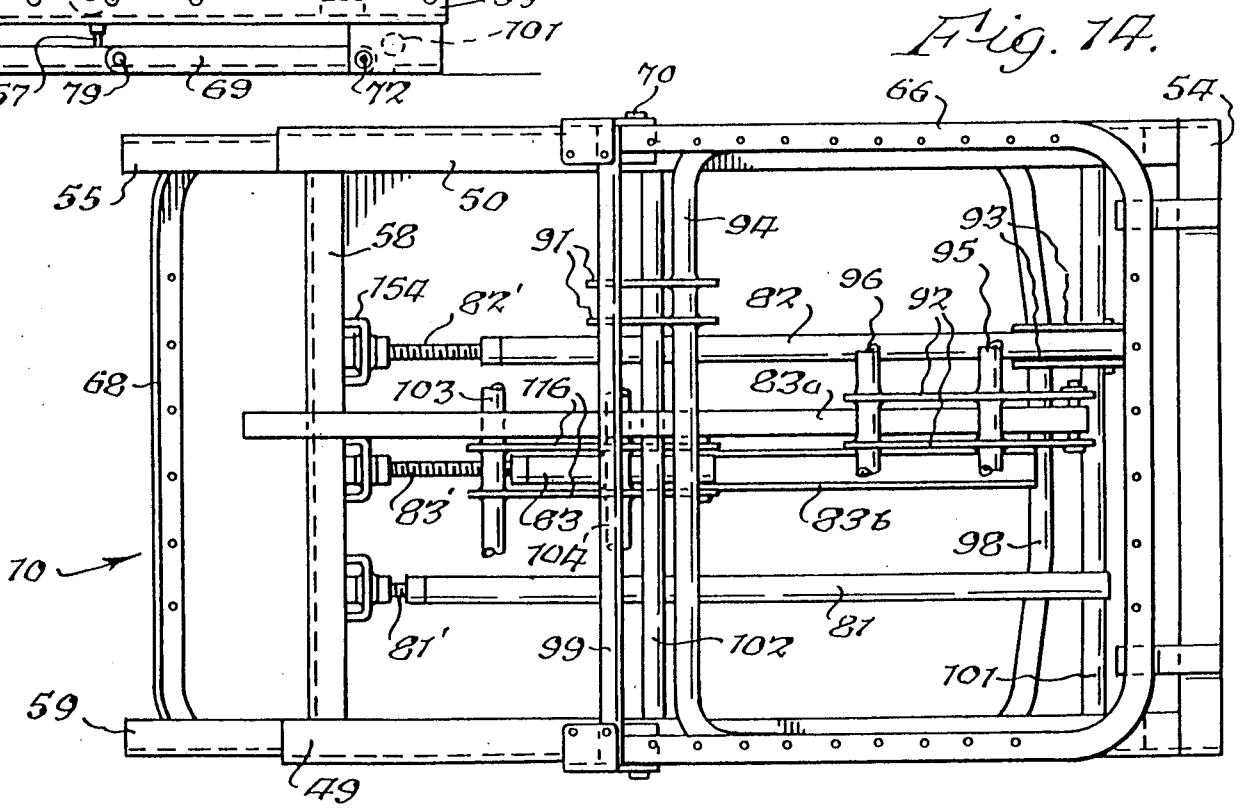

FIG. 14 is a top plan elevation of the bed shown in FIG. 13.

Figure 15:
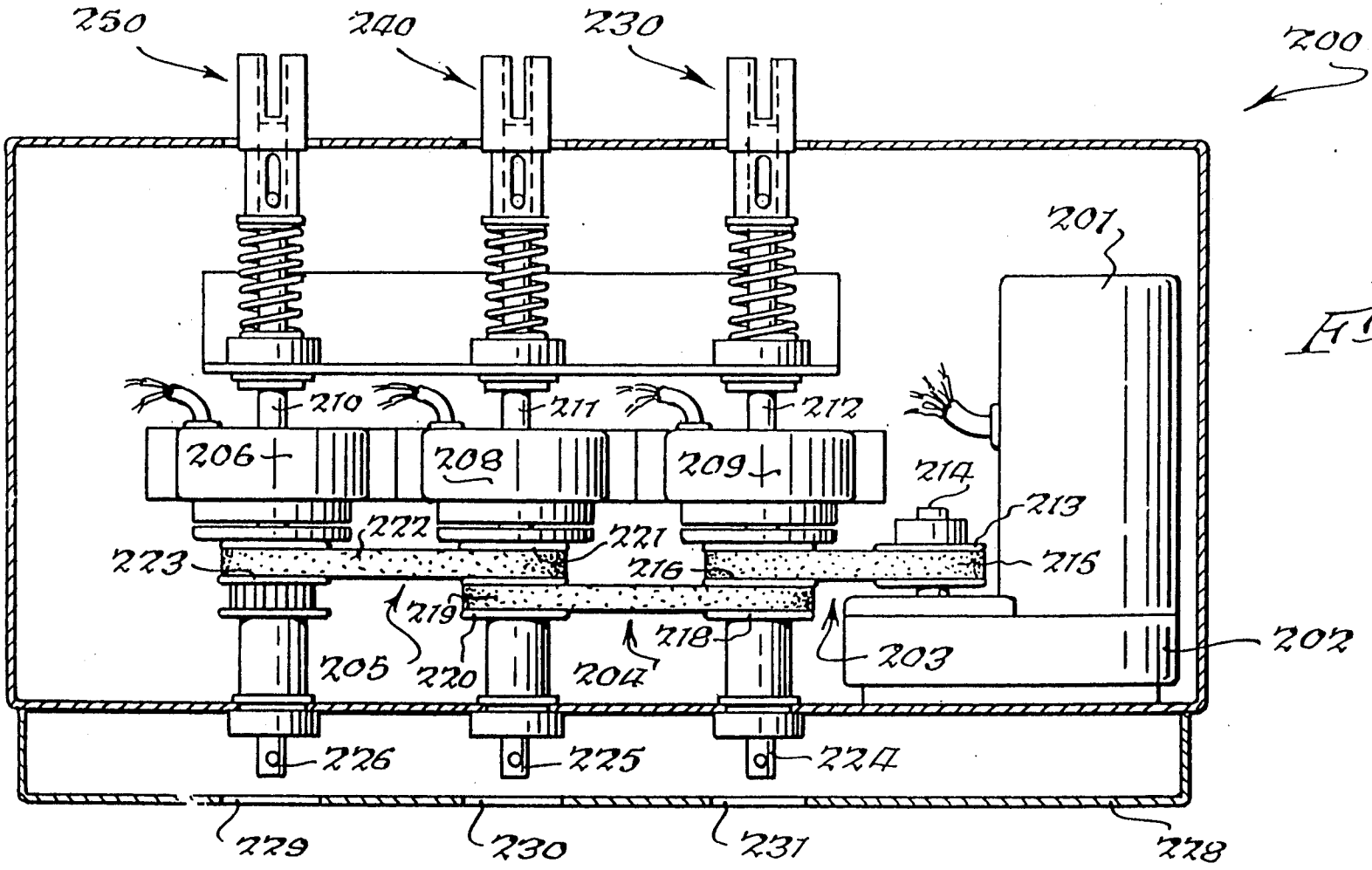

FIG. 15 is a top plan elevation of an alternative motor drive unit having a single motor and three clutches, taken just under the top wall of the drive unit housing.

DETAILED DESCRIPTION OF THE INVENTION

For purposes of the description which follows, the terms "upper", "lower", "left", "right", "front", "rear", "vertical", "horizontal", and derivatives thereof, refer to the invention as illustrated in the drawings from the perspective of a normal observer facing the drawings. The terms "foot" and "foot-end" refer to the end of the bed where the drive unit is secured, and where the user's feet would usually be, whereas the terms "head" and "head-end" refer to the opposite end of the bed, where the user's head would normally be. Identical drawing reference numbers on different drawing figures refer to identical elements What follows is a description of a preferred embodiment of the invention, illustrating the best mode of the invention known to the patentee. The claims are not intended to be limited in scope to the preferred embodiment described herein, but rather are intended to encompass variations thereof which are readily apparent to those having ordinary skill in the art. For example, an important point of novelty of the invention is the interchangeability of manual and powered drive units, where each unit controls a plurality of bed drive shafts and associated bed positions. In the preferred embodiment depicted, three separate drive shafts are shown for controlling the head, foot and general elevation of the bed, respectively. It is not intended that the claims of the invention be limited in scope to a bed with three drive shafts, however. The present invention is intended for adjustable beds with two, three, four, five or even more separately adjustable sections. The essence of the invention is that it permits the quick and easy interchangeability of the drive unit for the entire bed, regardless of how many separately adjustable sections the bed may have.

Similarly, the preferred embodiment shown includes a first powered drive unit with three electric motors, and a second powered drive unit with a single electric motor. However, the claims are not intended to be limited to a particular number of electric motors in the powered drive unit, nor is it necessary that the powered drive unit include electric motors at all; for example, hydraulic or pneumatic actuators could be employed as well.

Adverting now to the drawings, FIG. 1 is a top plan elevation of the adjustable bed 10 of the invention with manual drive unit 11 installed, and FIG. 2 is a side elevation of the bed shown in FIG. 1. It is to be noted that FIG. 2 illustrates the left side of the bed as viewed from the perspective of one facing the foot end of the bed. Although not completely shown in the drawings, the right side of the bed is identical to the left side, and so a detailed description thereof has been generally omitted for simplicity.

Bed 10 is generally of conventional construction, but with several important modifications to accommodate the interchangeability of the drive units and to facilitate nesting of the bed frame for easier storage and transport. The bed comprises frame 12 which is supported by dual head-end legs 15 which rest on casters 18, and dual foot-end legs 16 which rest on casters 19, and is sometimes also supported by head-end vertical support 20 and foot-end vertical support 21 (when the bed frame is not in an elevated position). (For convenience, reference numbers 15 & 16, 18 & 19, and 20 and 21 denote pairs of legs, casters and vertical supports, respectively, half of which pairs are shown in FIG. 2). A conventional spring-wire mattress support 120 covers the head, center and foot sections of the bed.

Frame 12 comprises head-end support section 54 and foot-end support section 55. Head-end support section 54 comprises side rails 49 and 50, transverse member 99, and head rail 51, all of which may, for example, be individually constructed of tempered steel and then welded together or otherwise secured. Similarly, foot-end support section 55 comprises side rails 56 and 59, transverse members 101 and 102, and coupling mounting bracket 58 which extends transversely across the side rails. Once again, the side rails may, for example, be constructed of tempered steel and welded or otherwise secured to the mounting bracket.

The respective side rails of the two U-shaped support sections 54 and 55 telescopingly engage one another and are joined together by locking pins 61 and 62 which pass through aligned bores in the side rails. For added stability and ease in alignment side rails 56 and 59 include inwardly protruding pins 63 and 64, respectively, which engage corresponding slots in the ends of side rails 50 and 49, respectively. Pins 61 and 62 may be easily removed to disassemble the bed.

Bed 10 includes a pivoting head section 66, pivoting foot and center sections 68 and 69, respectively, as well as a general elevation adjustment of frame 12 (as best shown in FIG. 4). Head section 66 pivots about pivot pins 70 and 71; and foot and center sections 68 and 69 pivot about stationary pivot pins 72, 73, 74 and 75, and moving pivot pins 76, 78, 79 and 80.

As best illustrated in FIG. 1, conventional screw jacks 81 and 82 are used to control the attitude of head section 66 and foot and center sections 68 and 69, respectively. Conventional screw jack 83 controls the general elevation of frame 12. Hand crank 84 turns controller shaft 81' which in turn drives jack 81; hand crank 85 turns controller shaft 83' which in turn drives jack 83; and hand crank 86 turns controller shaft 82' which in turn drives jack 82. Drive jack 81 is pivotally secured at pivot pin 88 to bracket 91 which is fixedly secured to transverse member 94 of head section 66. Drive jack 82 is pivotally secured at pivot pin 90 to bracket 93 which is fixedly secured to transverse member 98 of foot and center sections 68 and 69. Drive jack 83 is pivotally secured at pivot pin 89 to bracket 92 which is fixedly secured to transverse frame members 95 and 96. As shown in FIG. 2, transverse members 95 and 96 are fixedly secured to pivoting cross member 106 which, in turn, is pivotally secured to leg 15 at pivot pin 113 and to vertical support 20 at pivot pin 111. Pivoting cross member 105 is also pivotally secured to leg 15 at pivot pin 112 and to vertical support 20 at pivot pin 110. Drive jack 83 is pivotally secured at pivot pin 105' to bracket 119 which is fixedly secured to transverse frame members 103 and 104. Also as shown in FIG. 2, transverse members 103 and 104 are fixedly secured to pivoting cross member 109 which, in turn, is pivotally secured to leg 16 at pivot pin 118 and to vertical support 21 at pivot pin 115. Pivoting cross member 108 is also pivotally secured to leg 16 at pivot pin 116 and to vertical support 21 at pivot pin 114.

The bed's various functions are best illustrated by reference to FIGS. 3-5. FIG. 3 is a vertical cross-section of the bed with sections cut away, taken generally at line 3—3 of FIG. 1, with adjustable foot section 68 and center section 69 in an elevated position. To elevate foot section 68 and center section 69 as shown, hand crank 86 is rotated in a clockwise direction (from a perspective facing the foot-end of the bed). Hand crank 86 drives shaft 82' into the hollow tube of jack 82. Shaft 82' engages nut 122 which is secured inside the hollow tube of jack 82. As controller shaft 82' rotates in a clockwise direction, jack 82 travels rightwardly, causing bracket 93 through its mounting on center section 69 to pivot in a counterclockwise direction about hinge pivots 72 and 73, thereby rotating transverse member 98 and center section 69 about pivots 72 and 73 which are secured to center section 69. As center section 69 pivots in a counterclockwise direction, it raises the leftward end of foot section 68, which is pivotally secured to section 69 at pivot pin 79. As foot section 68 moves generally leftward, it causes member 121 to pivot in a counterclockwise direction about pivot pin 74 which is secured to frame 12. Turning hand crank 86 in the opposite direction lowers sections 68 and 69. It is important to note that when sections 68 and 69 are fully lowered, the left end of section 68 rests on stop 57 (as shown in FIGS. 2, 4 and 5) which is welded to the frame. Stop 57 serves two functions; it absorbs the force exerted by one sitting on the foot end of the bed and, as shown in FIG. 13, it helps to align the bed halves when nesting the halves together. Head rest 167 (shown in FIGS. 2-5), which is also welded to the frame, similarly functions t support head section 66.

FIG. 4 is a view similar to FIG. 3, except taken generally at line 4—4 of FIG. 1, and illustrates how hand crank 85 controls the general elevation of frame 12. To elevate frame 12 as shown, hand crank 85 is rotated in a clockwise direction (from a perspective facing the foot-end of the bed). It should be noted that the handle of hand crank 85 pivots about pin 124 to enable its handle to clear the other handles when cranking (the other two handles also include this pivoting feature). Hand crank 85 drives shaft 83' into the hollow tube of jack 83 (which includes head section 83*a* and foot section 83*b*). Shaft 83' engages nut 123 which is secured inside the hollow tube of jack 83. As controller shaft 83' rotates in a clockwise direction, jack 83 travels rightwardly, causing upward forces along legs 20 and 21, and downward forces along legs 15 and 16, which results in the left ends of brackets 119 and 92 raising the bed off the floor. Since transverse members 103 and 104 are secured to bracket 119, and transverse members 95 and 96 are secured to bracket 92, these transverse members are also elevated relative to the floor. Finally, transverse members 95 and 96 are secured to member 106 (see FIG. 2), and transverse members 103 and 104 are secured to member 109 (see FIG. 2), and members 106 and 109 are pivotally secured to legs 20 and 21 which are rigidly secured to frame 12. Thus it is seen that turning the handcrank in a clockwise direction results in elevating frame 12 whereas turning hand crank 85 in the opposite direction lowers frame 12.

FIG. 5 is a view similar to FIGS. 3 and 4, except taken generally at line 5—5 of FIG. 1. To elevate head section 66 as shown, hand crank 84 is rotated in a clockwise direction (from a perspective facing the foot-end of the bed). Hand crank 84 drives shaft 81' into the hollow tube of jack 81. Shaft 81' engages nut 124 which is secured inside the hollow tube of jack 81. As controller shaft 81' rotates in a clockwise direction, jack 81 travels rightwardly, causing bracket 91 to pivot in a clockwise direction about pivot pin 88, thereby raising transverse member 94 which is secured to head section 66. Turning hand crank 84 in the opposite direction lowers section 66.

Thus it is seen in FIGS. 3-5 that turning the appropriate crank in a clockwise direction elevates its associated bed section, whereas turning the crank in a counterclockwise direction lowers the particular section.

FIG. 6 is a foot-end elevation of the bed of FIG. 1, showing manual drive unit 11 installed. Also shown in FIG. 6 are quick connect/disconnect latches 125 and 126 which are pivotally secured to drive unit 11 at pivot pins 128 and 129, respectively. Secured to the housing of drive unit are mounting brackets 131 and 132 which slidingly engage square-shaped side rails 59 and 55, respectively. Once the drive units are slid into position, the latches interlock the drive unit with the side rails as shown in more detail in FIG. 9.

FIG. 7 is a fragmentary horizontal cross-section of the bed taken generally at line 7—7 of FIG. 6, which illustrates how the manual drive unit slidingly engages the foot-end of the bed frame. Note slots 133 and 134 in side rails 59 and 55, respectively.

FIG. 9 is a fragmentary section taken generally at line 9—9 of FIG. 6 which illustrates how the drive unit latches onto the bed frame. Side rail 59 includes slot 133 which receives straight portion 135 of latch 125 to lock drive unit 11 into place. Thus it is seen that replacing or interchanging the manual drive unit with another drive unit (either manual or powered) is quickly and easily accomplished by turning latches 125 and 126 and sliding out the drive unit and then reversing the process with the replacement unit. Indeed, the entire interchange can be accomplished in less than 30 seconds.

Both the manual and powered drive units include identical coupling assemblies (three assemblies in each unit) for coupling the drive to the appropriate screw jacks. FIG. 8 is a vertical cross-section of the manual drive unit and coupling assembly taken generally at line 8—8 of FIG. 7. Since all three coupling assemblies are identical within the manual drive unit, only coupling assembly 140 is described herein. Handcrank 84 generally comprises handle 142 secured to crank arm 141 which is pivotally secured to shaft extension 138 at pivot pin 124. The crank arm may be rotated in a counterclockwise direction about pin 124 to provide clearance and avoid interference with the center hand crank. Drive unit shaft 143 and its shaft extension 138 extend through a bore in wall 158 of drive unit 11 and are secured by bearing 148. Drive unit shaft 143 also extends through a bore in bracket 145 where it is further secured by bushing 144. Mounted on the distal end of shaft 143 is pin 149. Coupling 150, which includes slot 151, slidingly engages shaft 143. Spring 146 extends between bushing 144 and coupling 150, biasing the coupling leftwardly until pin 149 abuts the rightward end of slot 151. Drive shaft 81' extends through bushing 152 (which includes internal bearings not shown) which is mounted to mounting clevis 154. Drive shaft extension 153 of shaft 81' includes pin 156 which engages an open-ended slot (shown more clearly in FIG. 12A) in the leftward end of coupling 150. Thus, it is seen how rotating handcrank 84 drives shaft 81' to cause jack 81 to operate.

The motor drive unit 160 mounts in exactly the same manner as the manual drive unit, as shown in FIGS. 10, 11, 12 and 12A. The obvious difference between the two units is that the handcranks of the manual unit are replaced by electric motors in the powered drive unit. FIG. 10 is a view similar to FIG. 6, except illustrating the motor drive unit installed in the bed, and FIG. 11 is a view similar to FIG. 7.

FIG. 12 illustrates a vertical cross-section of the motor drive unit and coupling assembly taken generally at line 12—12 of FIG. 11. Motor 161 is mounted to the drive unit housing and drives motor shaft 165 through gear reducer 162. The motor is controlled by motor control 163, also mounted to the housing. Motor leads 171 are shown disconnected but would of course be connected to control circuit 163. Not shown in the drawings is a clutch which engages the gear reducer when activated by control circuit 163. (Note that the clutch is optional and may not be necessary depending upon the gear ratio of the gear reducer.) In the event of motor failure or electrical failure the clutch is disconnected which permits the jack to be driven by an emergency handcrank which may be secured to shaft extension 164.

Mounted on motor shaft 165 are pins 168 and 173. Coupling 169, which includes slot 170, slidingly engages shaft 165. Spring 166 extends between washer 172 which abuts pin 173 and coupling 169, biasing the coupling leftwardly until pin 168 abuts the rightward end of slot 170. Drive shaft 81' extends through bushing 152 (which includes internal bearings not shown) which is mounted to mounting clevis 152. Drive shaft extension 153 of shaft 81' includes pin 156 which engages an open-ended slot (shown more clearly in FIG. 12A) in the leftward end of coupling 150. Thus, it is seen how the motor rotates shaft 81' to cause jack 81 to operate.

FIG. 12A is a partially exploded horizontal cross-section taken along line 12A—12A of FIG. 12, illustrating the coupling of the drive unit to the drive jack. Clevis 154 is pivotally mounted to angle brackets 175 and 176 at pivot bolts 178 and 179, respectively. Angle brackets 175 and 176 are fixedly secured to mounting bracket 58 by nut/bolt 180 and 181, respectively.

The pivoting action of controller shaft 81', and jack 81, is a subtle but important part of the present invention. This feature is perhaps best appreciated with respect to FIG. 5, which shows head section 66 in an elevated position. Since bracket 91 is rigidly secured to transverse member 94 (which in turn is part of head section 66) and pivotally secured to jack 81 at pin 88, it necessarily follows that jack 81 must be capable of vertical "play" as it operates. As shown in FIG. 5, jack 81 pivots through an angle theta as head section 66 is raised or lowered. This movement is made possible by the unique mounting of clevis 154 to bracket 58. It should be noted that all three jacks are mounted in the same way, and each pivots somewhat during operation, as shown in FIGS. 3–5.

FIG. 12A also illustrates the manner in which coupling 169 engages shaft 153. Cylindrical pin 156 is rigidly secured to, and extends outwardly on two sides from shaft 153. In operation, pin 156 engages slot 182 (shown in FIGS. and 12A) of coupling 169. When installing the drive unit, it is obviously unlikely that all three of the slotted couplings will align with their respective shaft pins (in fact, usually none of the couplings are aligned). With reference to FIG. 12A, for example, it is seen that as coupling 169 is moved leftwardly towards shaft 153 that pin 156 will come into contact with annular surface 183 of coupling 169. As the drive unit moves further leftward, spring 166 compresses, and continues to compress until the drive unit is latched into place by latches 125 and 126. Thus it is seen that the drive unit can be completely installed into the bed, and yet one or more of the couplings may not be engaged with its respective shaft. However, as the drive unit shaft is rotated relative to the jack drive shaft (which remains stationary due to its relatively large inertia) eventually slot 182 will become aligned with pin 156 and spring 166 will bias the coupling into mating engagement with the controller shaft. In other words, all three couplings will eventually spring into engagement with their respective controller shafts, as the controller shaft pins will "pop" into the slots of the couplings. This same mechanism operates with both the manual and powered drive units, and permits quick and simple interchangeability thereof.

It is sometimes desired to transport an adjustable bed from room to room or even from one building to another. In fact, it is much more likely that a need will arise to move an adjustable bed from place to place as compared to a conventional bed. To solve this problem, the bed of the present invention may be easily disassembled into two parts which then nest one within the other for compact storage and convenient transport. Adverting to FIG. 1, it is seen that the bed may be quickly disassembled by removing pins 61 and 62 which hold the frame side rails together, and by removing pins 88, 90, 105' and 184. Pins 184 and 105' hold head section **83*a* and foot section 83*b* of jack 83 together; pin 90 pivotally secures jack 82 to bracket 93; and pin 88 pivotally secures jack 81 to bracket 91**. Thus the bed may be easily disassembled by removing six pins.

FIG. 13 is a side elevation of the adjustable bed of the invention, illustrating how the bed may be separated into two pieces which nest together which makes the bed easier to transport or store and FIG. 14 is a top plan elevation of the bed shown in FIG. 13. It should be noted that jacks 81, 82 and 83 are offset in position in such a way to accommodate nesting, i.e., the jacks do not interfere with one another when the bed halves are stacked as shown in FIGS. 13 and 14. This spacing and orientation of the jacks is best seen with respect to FIG. 1. Although the distance between jacks 82 and 83 is equal to the distance between jacks 81 and 83, jack 81 is closer to the bottom rails than jack 82 is to the top rails.

FIG. 15 is a top plan elevation of an alternative motor drive unit having a single motor and three clutches. Drive unit 200 comprises motor 201 and belt drives 203, 204, and 205 through gear reducer 202. Magnetic clutches 206, 208 and 209 individually engage drive unit shafts 210, 211, and 212, respectively, with their respective pulleys. Drive 203 comprises drive sheave 213 which is mounted on gear reducer shaft 214, sheave 216 of foot section drive 230 which is mounted on drive shaft 224, and belt 215 which loops about sheaves 213 and 216. Drive 204 comprises sheave 218 which is mounted to shaft 224, sheave 220 of bed elevation drive 240 which is mounted on drive shaft 225, and belt 219 which loops about sheaves 218 and 220. Drive 205 comprises sheave 221 which is mounted to shaft 225, sheave 223 of head section drive 250 which is mounted to shaft 226, and belt 222 which loops about sheaves 221 and 223. A remote control unit, not shown, controls electric motor 201 and magnetic clutches 206, 208 and 209. For simplicity, the motor and clutches are shown with their lead wires unconnected. Motor 201 is reversible which permits the respective drive shafts to either raise or lower the respective bed sections. In normal operation, only one of the drive jacks is operated at a time, although it is conceivable that two or three of the jacks could be operated simultaneously, assuming all bed sections were either being raised or lowered together. The coupling mechanism of drive 200 is identical to that previously described, and the drive may be easily interchanged as previously discussed. It should be noted that drive 200 includes a shaft extension cover 228 which prevents bed sheets, etc. from becoming entangled with the shaft during operation. The cover includes three openings 229, 230, 231 which permit access to the shaft extensions to connect an emergency hand crank if necessary. It should be noted that, in the embodiment shown, it would be necessary to energize the magnetic clutch when cranking with the emergency crank.

It will thus be seen that the objects set forth above, among those made apparent from the preceding description, are efficiently obtained. Since certain changes may be made in carrying out the above invention and in the constructions set forth without departing from the scope of the invention, it is intended that all matter contained in the above description or shown in the accompanying drawings be interpreted as illustrative and not in a limiting sense. It is also to be understood that the following claims are intended to cover all of the generic and specific features of the invention herein described, and all statements of the scope of the invention, which, as a matter of language, might be said to fall therebetween.

What is claimed is:

1. An adjustable bed and interchangeable drive unit therefore, comprising:

a bed frame;

a plurality of separately adjustable bed sections pivotally secured to said frame;

a corresponding plurality of controller shafts wherein each shaft controls one of said adjustable sections;

a manual drive unit comprising a plurality of handcranks, wherein each of said handcranks controls one of said controller shafts;

a powered drive unit operatively arranged for controlling and driving all of said controller shafts; and quick disconnect/connect means for interchanging said manual drive unit and said powered drive unit, wherein only one of said drive units is secured to said bed at any one time, and wherein said manual and powered drive units comprise spring-biased couplings for connecting said drive unit to said plurality of controller shafts and wherein said quick disconnect/connect means includes a latch to secure said drive unit to said bed and bias said couplings against said plurality of controller shafts.

2. An adjustable bed as recited in claim 1 wherein said bed frame comprises two components which, when disconnected one from the other, nest compactly one within the other for convenient storage and transport of said bed.

3. An adjustable bed as recited in claim 1 wherein said powered drive unit comprises a single electric motor operatively arranged to separately drive each of said controller shafts.

4. An adjustable bed as recited in claim 1 wherein said powered drive unit comprises a plurality of electric motors wherein each motor is operatively arranged to drive one of said plurality of controller shafts.

5. An adjustable bed as recited in claim 1 wherein said couplings when biased are operatively arranged to lock into engagement with said plurality of controller shafts when said couplings are rotated relative to said shafts.

6. In an adjustable bed having a plurality of separately adjustable bed sections controlled by a corresponding plurality of controller shafts, the improvement of an interchangeable drive unit therefor, comprising:

a plurality of manual handcranks and associated couplings mounted in a housing; and, means for quickly connecting/disconnecting said housing in/from said bed, wherein said couplings lockingly engage said plurality of controller shafts when said housing is connected.

7. The improvement as recited in claim 6 wherein said interchangeable drive unit comprises spring-biased couplings for connecting said drive unit to said plurality of controller shafts and wherein said quick disconnect/connect means includes a latch to secure said drive unit to said bed and bias said couplings against said plurality of controller shafts.

8. The improvement as recited in claim 7 wherein said couplings when biased are operatively arranged to lock into engagement with said plurality of controller shafts when said couplings are rotated relative to said shafts.

* * * * *